US007104928B1

(12) United States Patent
Liu et al.

(10) Patent No.: US 7,104,928 B1
(45) Date of Patent: Sep. 12, 2006

(54) ROTATING AND SWINGING EXERCISER

(76) Inventors: Wei Ming Liu, 8F-2, No. 3, Ankang Road, Fonyuan City, Taichung Hsien 420 (TW); Scott Hung, No. 24, Lane 40, Damin 1st Street, Dinjie Tsuen, Dadu Hsiang, Taichung Hsien 432 (TW)

( * ) Notice: Subject to any disclaimer, the term of this patent is extended or adjusted under 35 U.S.C. 154(b) by 48 days.

(21) Appl. No.: 11/034,988

(22) Filed: Jan. 12, 2005

(51) Int. Cl.
*A63B 22/00* (2006.01)
*A63B 22/04* (2006.01)

(52) U.S. Cl. ..... 482/52; 482/53

(58) Field of Classification Search ..... 482/51–53, 482/148
See application file for complete search history.

(56) References Cited

U.S. PATENT DOCUMENTS 3,970,302 A * 7/1976 McFee ..... 482/53
4,496,147 A * 1/1985 DeCloux et al. ..... 482/53
5,453,065 A 9/1995 Lien et al. ..... 482/52
5,545,111 A * 8/1996 Wang et al. ..... 482/53
5,888,176 A 3/1999 Kuo ..... 482/53
5,906,561 A 5/1999 Lin ..... 482/52
6,102,833 A 8/2000 Chen ..... 482/53
6,582,344 B1 6/2003 Tang ..... 482/53

* cited by examiner

*Primary Examiner*—Stephen R. Crow
(74) *Attorney, Agent, or Firm*—Charles E. Baxley

(57) ABSTRACT

A rotating and swinging exerciser includes a base, a housing rotatably attached onto an axle of the base, a frame disposed on the base and having an inclined peripheral surface, and a lever pivotally secured to the housing with a pivot pin and having two foot pedals pivotally attached to two end portions. The lever is slidably engaged onto and movable along the inclined peripheral surface of the frame, and to cause the housing to rotate relative to the base. One of the foot pedals may be forced to move upwardly along the inclined peripheral surface of the frame when the other foot pedal is stepped downwardly by a user and when the lever is moved along the inclined peripheral surface of the frame.

14 Claims, 8 Drawing Sheets

ROTATING AND SWINGING EXERCISER

BACKGROUND OF THE INVENTION

1. Field of the Invention

The present invention relates to a rotating and swinging exerciser, and more particularly to a rotating and swinging exerciser having a simplified configuration for being easily stored and carried with users.

2. Description of the Prior Art

Various kinds of typical rotating and swinging exercisers have been developed and comprise a pair of foot pedals that may be stepped by the users for conducting stepping exercises, and may further comprise a rotatable mechanism for allowing the foot pedals to be rotated relative to a supporting base, particularly when the foot pedals are stepped by the users.

For example, U.S. Pat. No. 5,453,065 to Lien et al. discloses one of the typical rotating and swinging exercisers comprising a pair of foot pedals to be stepped by the users for conducting stepping exercises, and a rotatable supporting base to rotatably support the foot pedals, and to be actuated or rotated when the foot pedals are stepped by the users. However, a complicated coupling device is required to be coupled between the foot pedals and the supporting base, and a stationary supporting frame.

U.S. Pat. No. 5,888,176 to Kuo, and U.S. Pat. No. 5,906,561 to Lin disclose two further typical rotating and swinging exercisers comprising a pair of foot pedals to be stepped by the users for conducting stepping exercises, and a handle rotatably supported on a supporting base and rotatably coupled to the foot pedals, and to allow the handle to be actuated or rotated by the foot pedals when the foot pedals are stepped by the users. However, similarly, a complicated coupling device is required to be coupled between the foot pedals and the supporting base and the handle.

U.S. Pat. No. 6,102,833 to Chen discloses another typical rotating and swinging exerciser also comprising a pair of foot pedals to be stepped by the users for conducting stepping exercises, the foot pedals each includes a guide pillar extended therefrom and engageable with engageable with arcuate protrusions of a supporting base, to actuate and to rotate the foot pedals to rotate relative to the base. However, similarly, a complicated coupling device is required to be coupled between the foot pedals and the supporting base.

U.S. Pat. No. 6,582,344 to Tang discloses a still further typical rotating and swinging exerciser comprising a pair of foot pedals to be stepped by the users for conducting stepping exercises, and a rotatable supporting base to rotatably support the foot pedals, and to be actuated or rotated when the foot pedals are stepped by the users. However, similarly, a complicated coupling device is required to be coupled between the foot pedals and the supporting base.

The present invention has arisen to mitigate and/or obviate the afore-described disadvantages of the conventional rotating and swinging exercisers.

SUMMARY OF THE INVENTION

The primary objective of the present invention is to provide a rotating and swinging exerciser including a simplified configuration that may be easily manufactured and assembled.

The other objective of the present invention is to provide a rotating and swinging exerciser including a simplified configuration that is excellent for storing and transportation purposes.

The further objective of the present invention is to provide a rotating and swinging exerciser including a simplified configuration that may be easily and readily carried with users.

The still further objective of the present invention is to provide a rotating and swinging exerciser including a simplified configuration that may be used for conducting both stepping and twisting exercises.

In accordance with one aspect of the invention, there is provided a rotating and swinging exerciser comprising a base including an axle extended upwardly therefrom, a housing rotatably attached onto the axle of the base, a frame disposed on the base, and including an inclined peripheral surface formed thereon, and a lever pivotally secured to the housing with a pivot pin, and including two foot pedals pivotally attached to two end portions thereof, the lever being engaged onto and supported on the inclined peripheral surface of the frame, and movable along the inclined peripheral surface of the frame, and to cause the housing to rotate relative to the base when the lever is moved along the inclined peripheral surface of the frame. A first foot pedal of the foot pedals may be caused and forced to move upwardly along the inclined peripheral surface of the frame when a second foot pedal of the foot pedals is stepped downwardly by a user and when the lever is moved along the inclined peripheral surface of the frame, and the second foot pedal may be caused and forced to move upwardly along the inclined peripheral surface of the frame when the first foot pedal is stepped downwardly by the user.

The housing includes a space formed therein, and the lever is received in the space of the housing, and pivotally secured to the housing with the pivot pin. The housing is rotatably attached onto the axle of the base with a gasket or a bearing. The gasket includes a bore formed therein to rotatably receive the axle. The gasket includes an enlarged seat extended therefrom, for stably engaged onto the beam.

A retarding device may further be provided for applying a retarding force against a rotational movement of the housing relative to the base. The retarding device includes at least one magnet attached to the housing or to the gasket, for acting with the base.

A link may further be provided and coupled between the foot pedals. The link is pivotally secured to the housing with a pivot rod, and is coupled between the foot pedals.

A cover may further be provided and secured onto the frame, and including a channel formed therein to slidably receive the lever, and to allow the lever to be slidably engaged onto the inclined peripheral surface of the frame. The cover includes a display or a control device disposed thereon. The base includes two opposite bars and a beam secured and coupled between the bars. The base includes a handle secured onto the base, for supporting upper portions of users.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
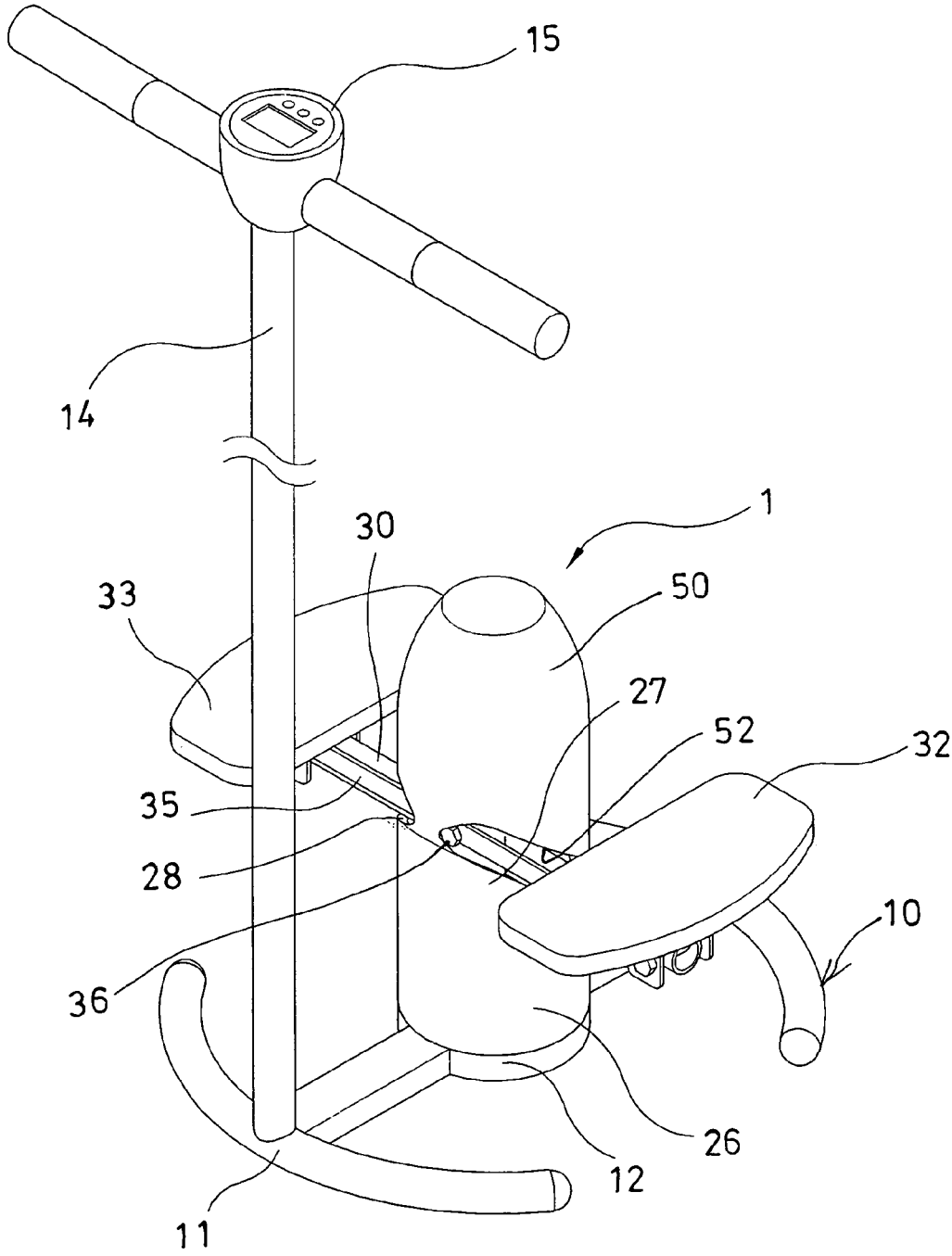
FIG. 1 is a perspective view of a rotating and swinging exerciser in accordance with the present invention.
Figure 2:
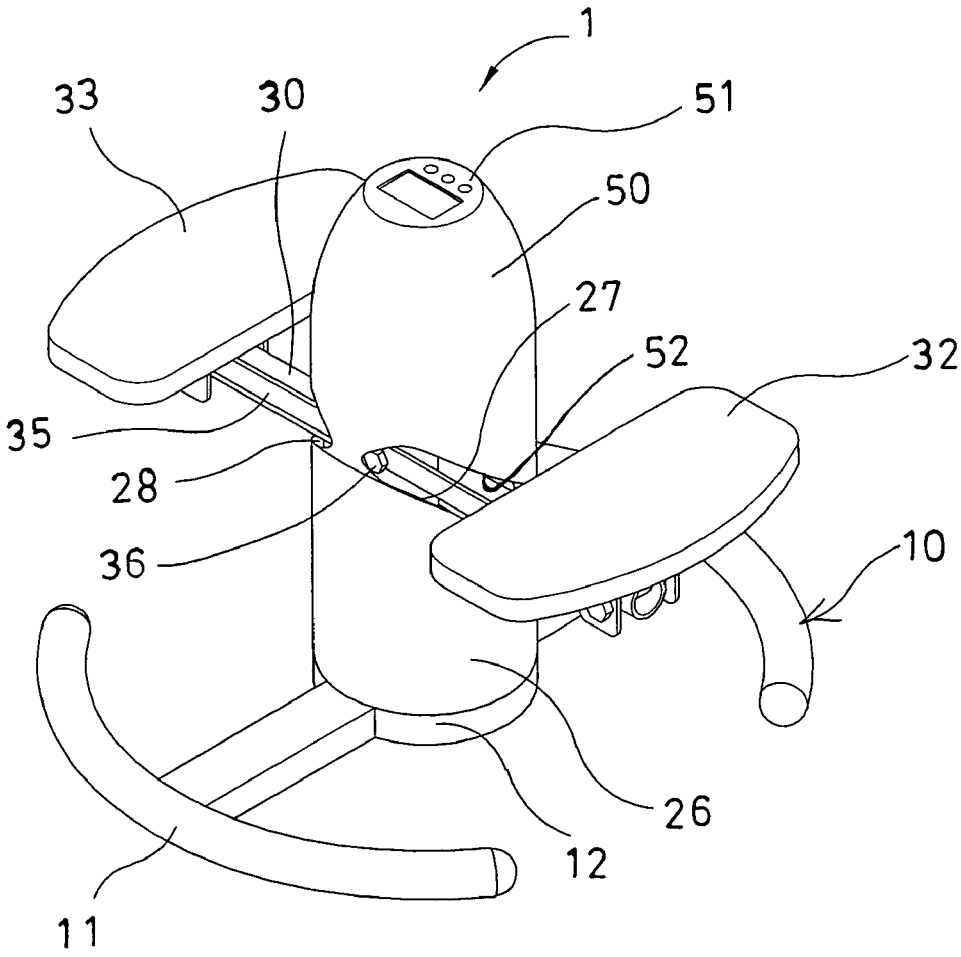
FIG. 2 is another perspective view of the rotating and swinging exerciser, in which a handle has been removed from the supporting base.
Figure 3:
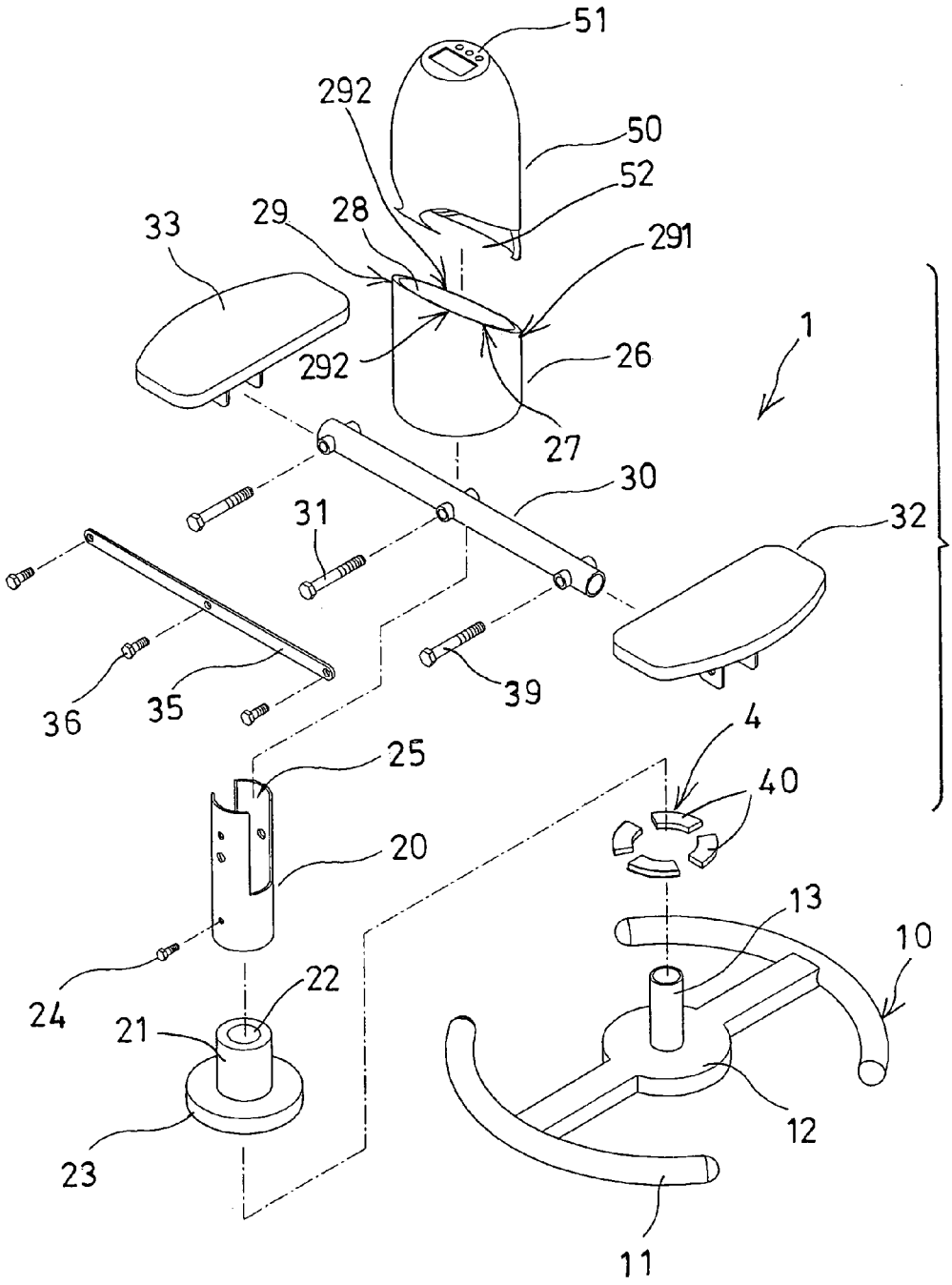
FIG. 3 is an exploded view of the rotating and swinging exerciser.

Referring to the drawings, and initially to FIGS. 1–3, a rotating and swinging exerciser 1 in accordance with the present invention comprises a base 10 including two curved and opposite bars 11, a beam 12 secured and coupled between the bars 11, and an axle 13 extended upwardly from the beam 12. A handle 14 may further be provided and secured onto the base 10 with such as fasteners or latches (not shown) or the like, for supporting the upper portions of the users, and may further include a display or control device 15 disposed thereon.

A tube or a housing 20 is rotatably attached or engaged onto the axle 13 of the base 10 with such as bearings (not shown), or a gasket 21, in which the gasket 21 may include a bore 22 formed therein to rotatably receive the axle 13, and an enlarged seat 23 extended therefrom, for stably engaged onto the beam 12. The housing 20 may be secured to the gasket 21 with one or more fasteners 24, to allow the housing 20 and the gasket 21 to be rotated in concert with each other, relative to the base 10. The housing 20 includes a space 25 formed therein and facing upwardly.

A frame 26 may further be provided and secured onto the base 10 or the beam 12 with such as fasteners or latches (not shown) or the like, or by welding processes, and includes an upper portion 27 having an inclined peripheral surface 28 formed or provided thereon. The inclined peripheral surface 28 of the frame 26 is inclined downwardly from a front portion 29 toward a rear portion 291, to form or define two inclined side portions 292, best shown in FIGS. 3 and 7–8.

A lever 30 includes a middle portion received in the space 25 of the housing 20, and pivotally or rotatably secured to the housing 20 with a pivot pin 31, and includes two foot pedals 32, 33 pivotally attached to two end portions thereof with such as pivot pins 39. The lever 30 is engaged onto or supported on the inclined side portions 292 of the inclined peripheral surface 28 of the frame 26, and movable along the inclined peripheral surface 28 of the frame 26, to cause the housing 20 to rotate relative to the base 10.

It is preferable that a link 35 is further provided and coupled between the foot pedals 32, 33, and preferably includes a middle portion pivotally or rotatably secured to the housing 20 with a pivot rod 36, in order to stably couple the foot pedals 32, 33 together. For example, the lever 30 and the link 35 may form a stable rectangular or parallelepiped structure to stably support or couple the foot pedals 32, 33 together, and to stably attach the foot pedals 32, 33 on the housing 20.

A resistive or retarding means or device 4 may further be provided to apply a resistive or retard force against the rotational movement of the housing 20 relative to the base 10. For example, the resistive or retarding device 4 includes one or more magnets 40 secured to bottom of the enlarged seat 23 of the gasket 21, or directly attached to bottom of the housing 20, for acting with the beam 12 that is preferably made of metal or magnetically attractive materials, in order to generate magnetic resistive or retarding forces against the housing 20 and thus the foot pedals 32, 33.

Figure 7:
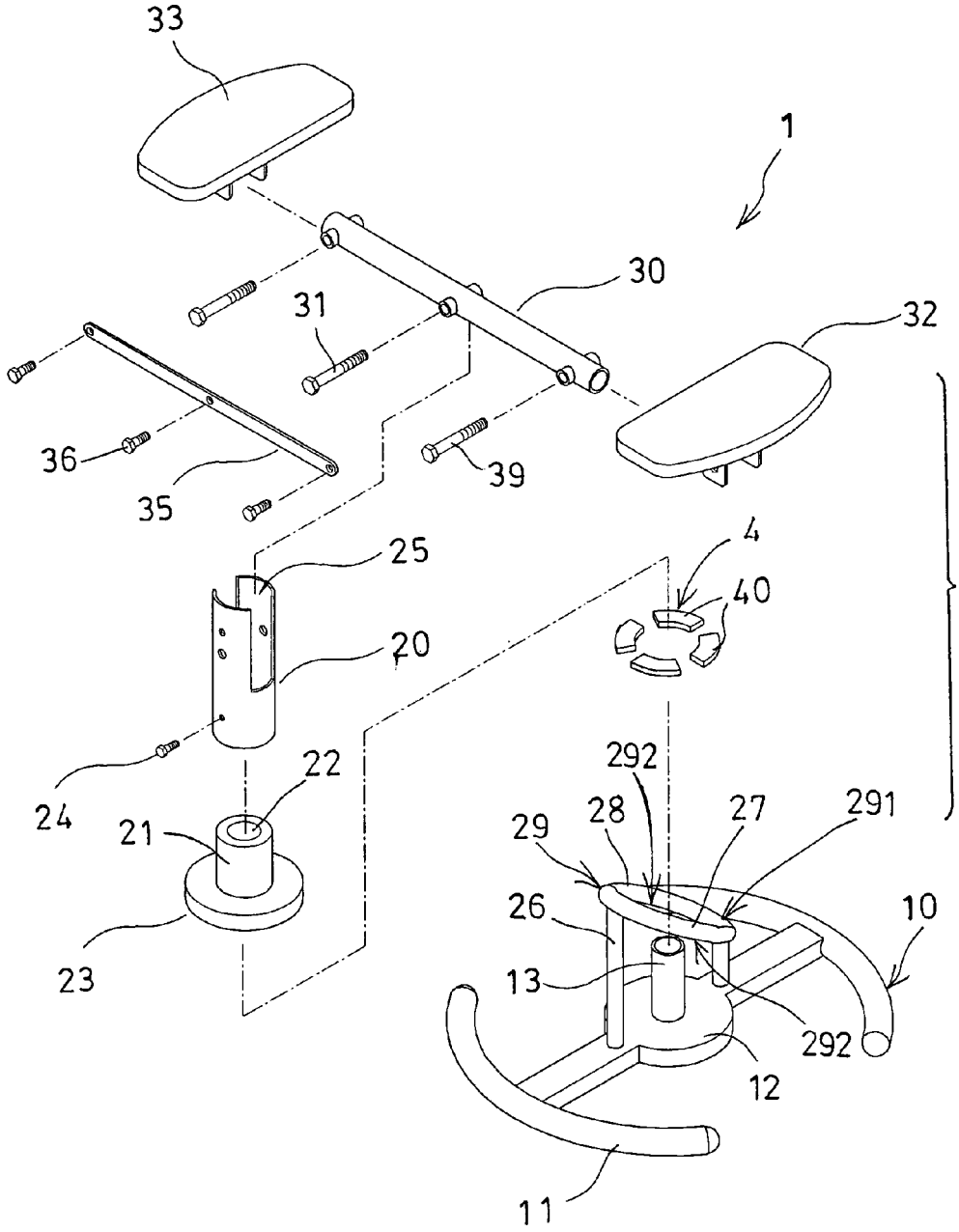
FIG. 7 is an exploded view similar to FIG. 3, illustrating the other arrangement of the rotating and swinging exerciser.
Figure 8:
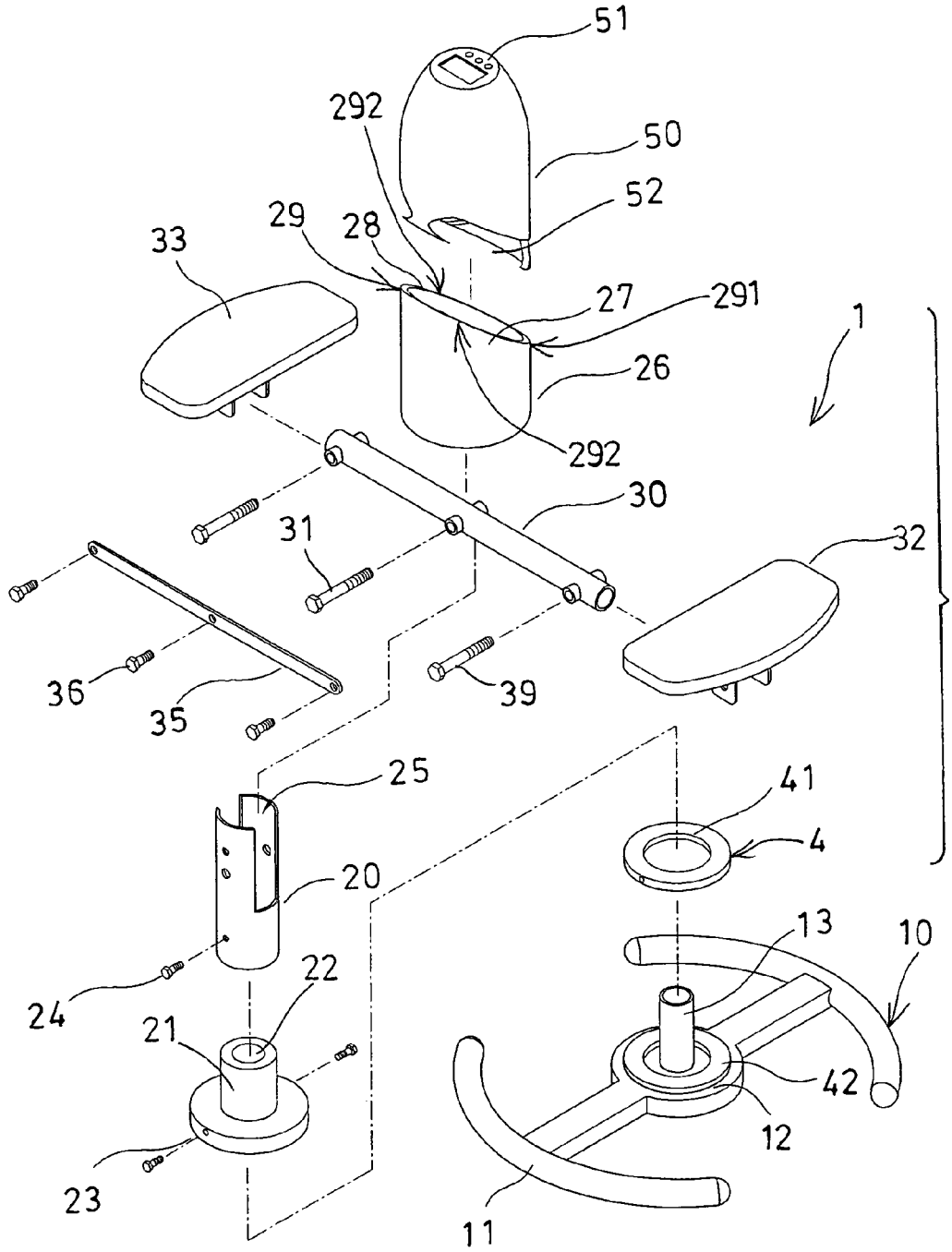
FIG. 8 is an exploded view similar to FIGS. 3 and 7, illustrating the further arrangement of the rotating and swinging exerciser.

Alternatively, as shown in FIG. 7, the frame 26 may be formed with wires or rods, and may be directly attached onto the beam 12 of the base 10. Further alternatively, as shown in FIG. 8, the resistive or retarding device 4 may include a brake shoe 41 secured to bottom of the enlarged seat 23 of the gasket 21, and another brake shoe 42 secured on the beam 12 of the base 10, for acting with the brake shoe 41, and thus for applying a resistive or retarding force against the housing 20 and thus the foot pedals 32, 33.

Figure 4:
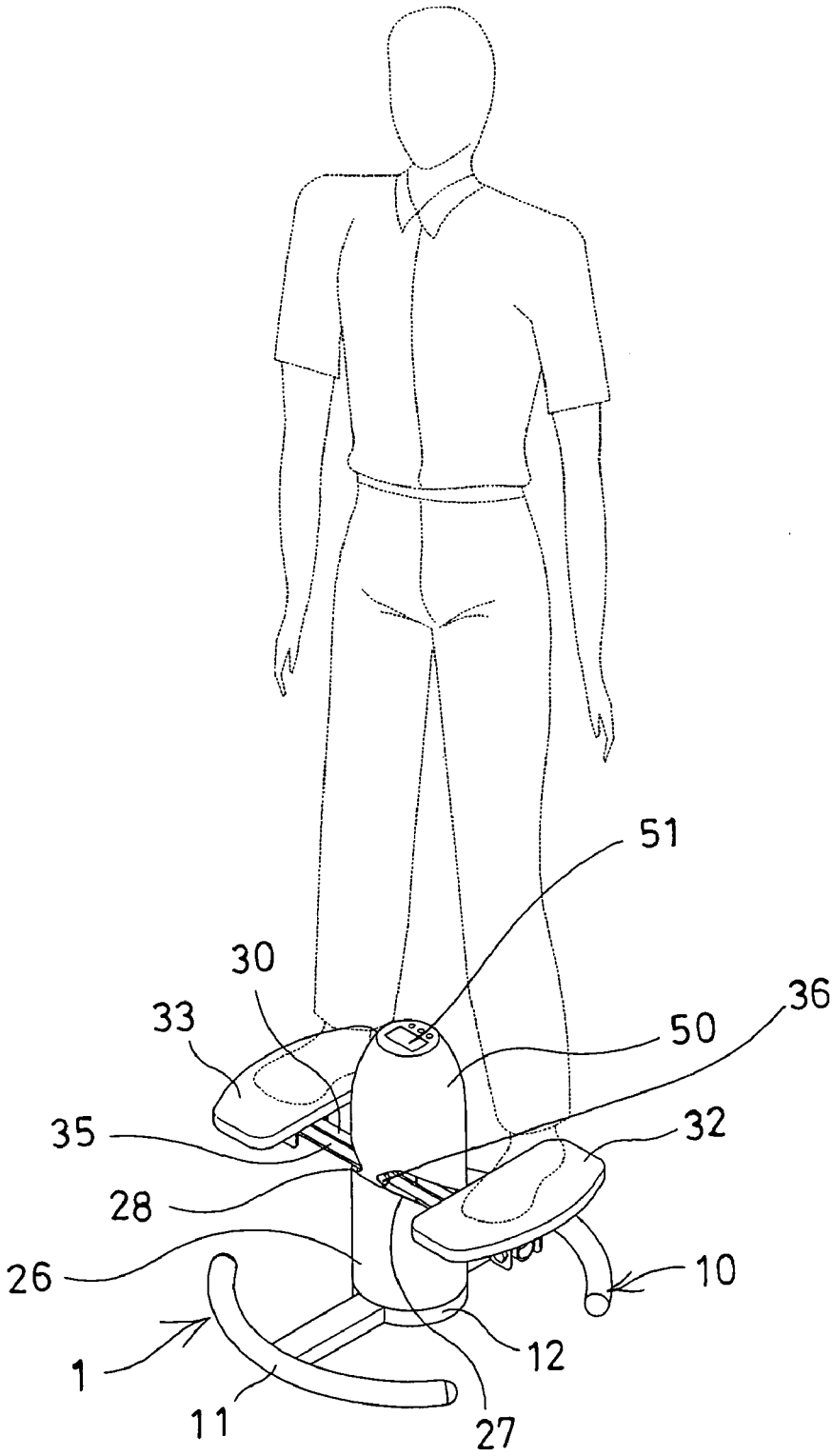
FIG. 4 is a perspective view illustrating the operation of the rotating and swinging exerciser.
Figure 5:
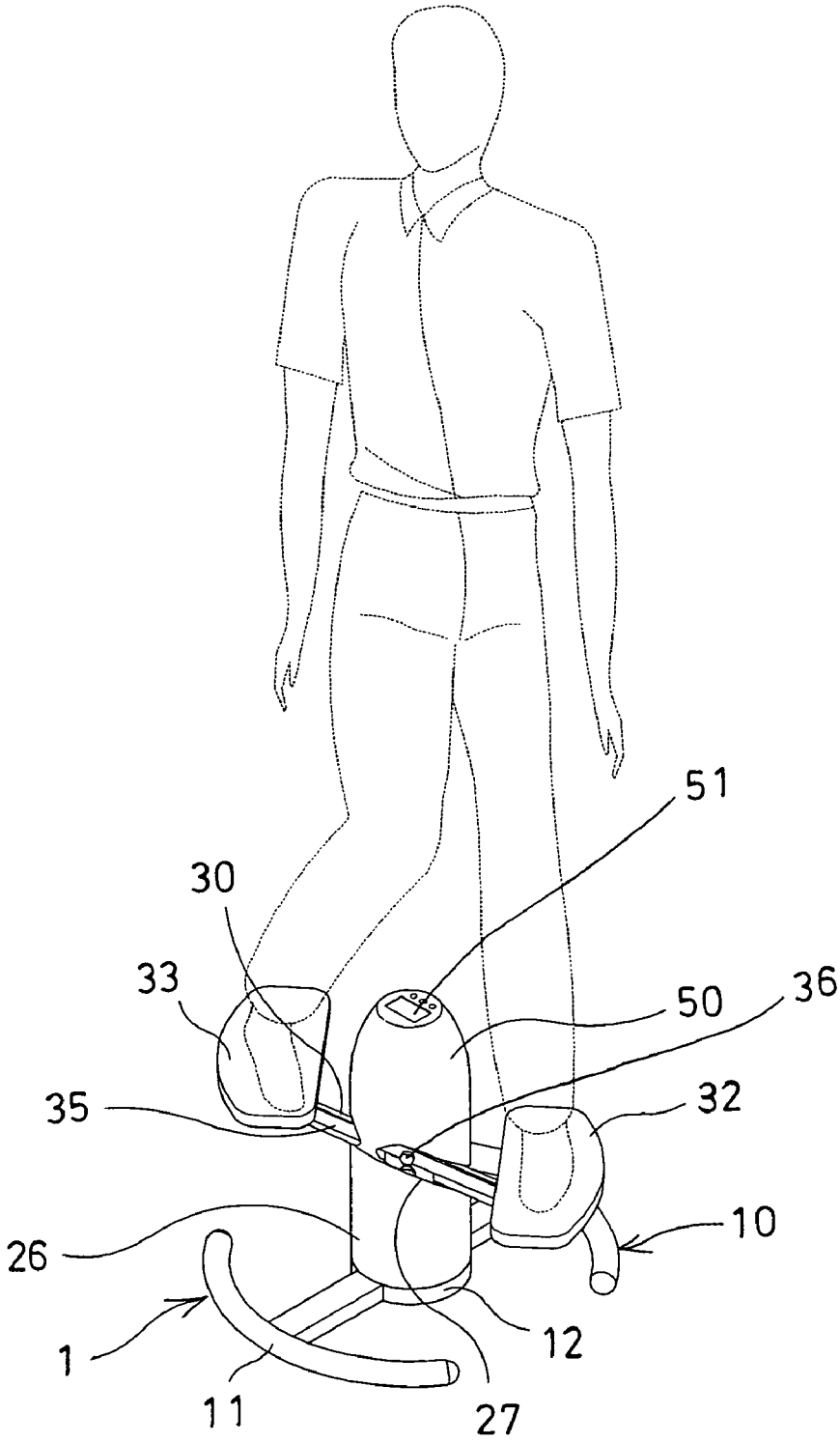
FIGS. 5, 6 are perspective views similar to FIG. 4, illustrating the operation of the rotating and swinging exerciser.
Figure 6:
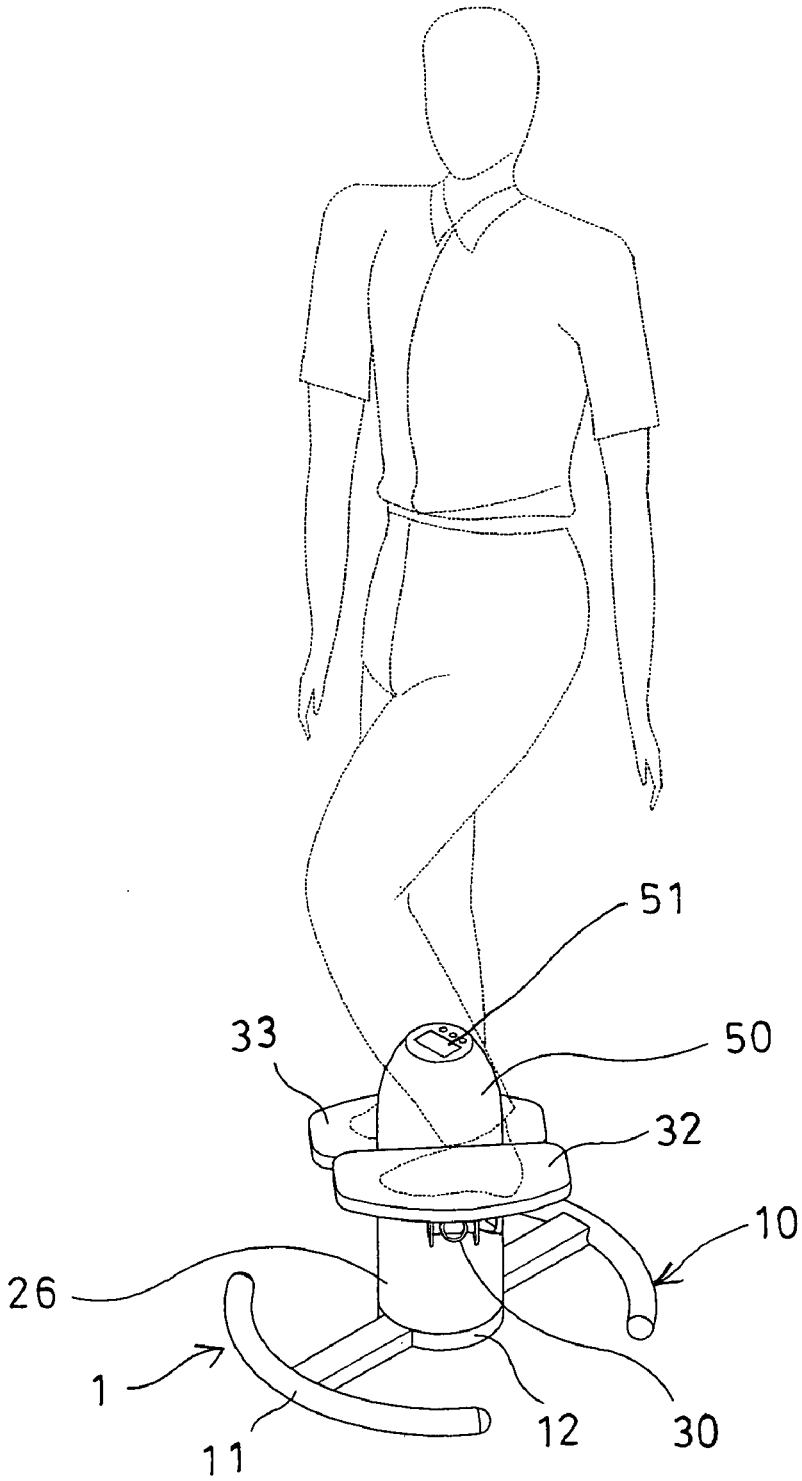

In operation, as shown in FIGS. 4–6, when one of the foot pedals 32 is stepped downwardly by the user (FIG. 5), the lever 30 may be caused and forced to move downwardly along the inclined side portion 292 of the inclined peripheral surface 28 of the frame 26, and the other foot pedal 33 may be caused and forced to move upwardly along the inclined side portion 292 of the inclined peripheral surface 28 of the frame 26 simultaneously. At this moment, the housing 20 may also be caused and forced to rotate relative to the base 10 by the lever 30.

On the contrary, as shown in FIG. 6, when the other foot pedal 33 is stepped downwardly by the user, the lever 30 may also be caused and forced to move downwardly along the inclined side portion 292 of the inclined peripheral surface 28 of the frame 26, and the other foot pedal 32 may also be caused and forced to move upwardly along the inclined side portion 292 of the inclined peripheral surface 28 of the frame 26 simultaneously. At this moment, the housing 20 may also be caused and forced to rotate relative to the base 10 by the lever 30.

The housing 20 and the foot pedal 32 may thus be caused and forced to rotate relative to the base 10 by the lever 30, such that the user may conduct stepping and swinging exercises simultaneously, with the simplified configuration having a lever 30 pivotally attached to a housing 20 and slidably engaged onto an inclined peripheral surface 28 of a frame 26.

A cover 50 may further be provided and secured onto the frame 26 with such as fasteners or latches (not shown) or the like, or by welding processes, and may also include a display or control device 51 disposed thereon, for showing exercising condition of the exerciser 1, and may include one or more, such as two channels 52 formed in the lower portion thereof, to slidably receive the lever 30, and to allow the lever 30 to be slidably engaged onto the inclined peripheral surface 28 of the frame 26.

Accordingly, the rotating and swinging exerciser in accordance with the present invention includes a simplified configuration for being easily stored and carried with users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rotating and swinging exerciser comprising:

a base, a housing rotatably attached onto said base with an axle, a frame disposed on said base, and including an inclined peripheral surface formed thereon, and a lever pivotally secured to said housing with a pivot pin, and including two foot pedals attached to two end portions of said lever, said lever being engaged onto and supported on said inclined peripheral surface of said frame, and movable along said inclined peripheral surface of said frame, and to cause said housing to rotate relative to said base when said lever is moved along said inclined peripheral surface of said frame, and a first foot pedal of said foot pedals forced to move upwardly along said inclined peripheral surface of said frame when a second foot pedal of said foot pedals is stepped downwardly by a user and when said lever is moved along said inclined peripheral surface of said frame, and said second foot pedal forced to move upwardly along said inclined peripheral surface of said frame when said first foot pedal is stepped downwardly by the user wherein the foot pedals rotate about a generally vertical axis as they move along the inclined peripheral surface.

2. The rotating and swinging exerciser as claimed in claim 1, wherein said housing includes a space formed therein, and said lever is received in said space of said housing, and pivotally secured to said housing with said pivot pin.

3. The rotating and swinging exerciser as claimed in claim 1, wherein said housing is rotatably attached onto said axle of said base with a gasket.

4. The rotating and swinging exerciser as claimed in claim 3, wherein said gasket includes a bore formed therein to rotatably receive said axle.

5. The rotating and swinging exerciser as claimed in claim 3, wherein said gasket includes an enlarged seat extended therefrom, for stable engagement onto said beam.

6. The rotating and swinging exerciser as claimed in claim 1 further comprising a retarding means for applying a retarding force against a rotational movement of said housing relative to said base.

7. The rotating and swinging exerciser as claimed in claim 6, wherein said retarding means includes at least one magnet attached to said housing, for acting with said base.

8. The rotating and swinging exerciser as claimed in claim 7, wherein said housing is rotatably attached onto said axle of said base with a gasket, said gasket includes an enlarged seat extended therefrom, and said at least one magnet is attached to said enlarged seat of said gasket.

9. The rotating and swinging exerciser as claimed in claim 1 further comprising a link coupled between said foot pedals.

10. The rotating and swinging exerciser as claimed in claim 9, wherein said link is pivotally secured to said housing with a pivot rod, and is coupled between said foot pedals.

11. The rotating and swinging exerciser as claimed in claim 1 further comprising a cover secured onto said frame, and including a channel formed therein to slidably receive said lever, and to allow said lever to be slidably engaged onto said inclined peripheral surface of said frame.

12. The rotating and swinging exerciser as claimed in claim 11, wherein said cover includes a control device disposed thereon.

13. The rotating and swinging exerciser as claimed in claim 1, wherein said base includes two opposite bars and a beam secured and coupled between said bars.

14. The rotating and swinging exerciser as claimed in claim 1, wherein said base includes a handle secured onto said base, for supporting upper portions of users.

* * * * *